US006497323B2

(12) United States Patent
Lewis

(10) Patent No.: US 6,497,323 B2
(45) Date of Patent: Dec. 24, 2002

(54) METHOD AND SYSTEM FOR STORING MINIATURES

(76) Inventor: Michael C. Lewis, 1862 Northwest Cir., San Jose, CA (US) 95131

( * ) Notice: Subject to any disclaimer, the term of this patent is extended or adjusted under 35 U.S.C. 154(b) by 43 days.

(21) Appl. No.: 09/735,686

(22) Filed: Dec. 12, 2000

(65) Prior Publication Data

US 2002/0070143 A1 Jun. 13, 2002

(51) Int. Cl.[7] ..... B65D 69/00
(52) U.S. Cl. ..... 206/575; 206/487; 312/119
(58) Field of Search ..... 206/759, 764, 206/575, 487; 446/73, 268; 312/119, 126

(56) References Cited

U.S. PATENT DOCUMENTS 834,452 A * 10/1906 Beiser ..... 206/564
925,273 A * 6/1909 Beiser ..... 16/266
1,252,779 A * 1/1918 Chrapla ..... 446/268
4,650,077 A * 3/1987 Droz ..... 206/480
5,013,278 A * 5/1991 Dixon et al. ..... 446/219
6,352,321 B1 * 3/2002 Munoz ..... 206/564

* cited by examiner

*Primary Examiner*—David T. Fidei
(74) *Attorney, Agent, or Firm*—Sawyer Law Group LLP

(57) ABSTRACT

A method and system for storing at least one miniature is disclosed. Each of the at least one miniature includes a base and a model. The base has a shape. The method and system include providing a tray and a tray container. The tray has a slot therein. The slot is for holding the base of each of the at least one miniature. In one aspect, the slot is configured such that a portion of the slot conforms to the shape of the base. In another aspect, the slot has a stationary portion and a movable portion. The stationary and movable portions of the slot are to allow the at least one miniature to be placed within the slot and to allow a portion of the slot to conform to the shape of the base. The tray container is for storing the tray.

16 Claims, 8 Drawing Sheets

METHOD AND SYSTEM FOR STORING MINIATURES

FIELD OF THE INVENTION

The present invention relates to miniatures, and more particularly to a method and system for storing miniatures in a secure manner.

BACKGROUND OF THE INVENTION

Individuals throughout the world collect miniatures, such as wargaming or collectible miniatures. FIGS. 1A and 1B generally depict miniatures 10 and 20. Each miniature 10 and 20 typically includes a base 12 and 22, respectively, and a model 14 and 24, respectively. The bases 12 and 22 are typically rectangular (e.g. square), as is the base 12, or circular, as is the base 22. In addition, the bases 12 and 22 are typically standard sized. For example, the circular base 22 is typically twenty-five millimeters in diameter at the bottom. The square base 12 is typically twenty millimeters by twenty millimeters, twenty-five millimeters by twenty-five millimeters or forty millimeters by forty millimeters at the bottom. Both the rectangular base 12 and the circular base 22 have sloped, or beveled, edges. The edges of the base 12 and the base 22 are sloped at approximately the same angle. In contrast, the size of the models 14 and 24 vary greatly in both size and shape. For example, the models 14 and 24 typically range between one-half and three inches in height. In addition, the models 14 and 24 are typically relatively fragile. Thus, it is easy to break a portion of the miniature 10 and 20.

Because individuals often collect a large number of miniatures 10 and 20, some mechanism for storing and transporting the miniatures 10 and 20 is desired. The mechanism should hold the miniatures 10 and 20 securely to prevent damage. However, it is desirable for the mechanism not to contact the models 14 and 24 to prevent wear and tear on the models 14 and 24, respectively.

FIG. 2 depicts a conventional case 30 for storing miniatures. The conventional case 30 typically has a plastic shell (not shown). Within the shell, a conventional foam separator 32 and a conventional foam insert 34 are used to store miniatures. The conventional foam separator 32 is used to separate layers of the conventional foam insert 34, allowing many miniatures 10 and 20 to be stored. The conventional foam separator 32 is typically approximately one half inch in thickness. Several apertures 34 (only one of which is labeled) are typically cut in the conventional foam insert 34. The conventional foam insert 34 is typically one inch thick. Each aperture 36 is typically one inch by one and one half inch. Each aperture 36 is for holding a single miniature 10 or 20. Thus, an individual would insert miniatures 10 and 20 into the apertures 36 of a conventional foam insert 34, separate different foam inserts using the conventional foam separator 32, and stack these layers within the plastic shell (not shown).

Although the conventional case 30 functions for some miniatures 10 and 20, one of ordinary skill in the art will readily recognize that it has several drawbacks. Most notably, the conventional case does not provide adequate protection for many miniatures 10 and 20. Miniatures which have bases that are larger than the apertures 36 require that the apertures 36 be modified. For miniatures 10 having a base that is forty millimeters by forty millimeters, the apertures 36 often must extend through several layers of foam inserts 34. On the other hand, miniatures 10 and 20 which are too small for the apertures 36 are often jostled during transportation in the conventional case 30. These miniatures 10 and 20 may suffer damage during transportation in the conventional case 30.

FIG. 3 depicts a portion of another conventional case 50. The case 50 typically has a hinged outer shell (not shown) that is in function to a suitcase. Within the outer shell are conventional foam inserts 52 and 54. Each conventional foam insert 52 and 54 has a conventional dimpled pattern 56 and 58, respectively. The dimpled patterns 56 and 58 have a shape that is sometimes known as an "egg-crate" or "egg-carton" pattern. The conventional dimpled patterns 56 and 58 are formed to interlock. In other words, where one conventional dimpled pattern 56 or 58 is concave, the other conventional dimpled pattern 58 or 56, respectively, is convex. The conventional foam inserts 52 and 54 are also very soft. In order to use the conventional case 50, miniatures 10 and 20 are placed in the depressions of one of the conventional dimpled patterns 56 or 58. When the conventional case 50 is closed, the interlocking nature of the conventional dimpled patterns 56 and 58 helps to hold the miniature 10 or 20 in the depression in which the miniature 10 or 20 was placed.

Although the conventional case 50 functions, miniatures 10 and 20 may be damaged when carried in the conventional case 50. The interlocking conventional dimpled patterns 56 and 58 often allow the miniatures 10 and 20 stored therein to move to a certain extent. Thus, the miniatures 10 and 20 might be damaged. In addition, the models 14 and 24 often have small features that poke into the conventional foam inserts 52 and 54. Thus, when the conventional case 50 is opened, the miniature 10 or 20 may stick to the top of the case. Furthermore, the miniatures 10 and 20 stored in the conventional case 50 must be spaced apart to prevent them from contacting each other and causing damage. Thus, the conventional case 50 cannot hold a high density of miniatures.

Accordingly, what is needed is an improved system and method for storing miniatures. The present invention addresses such a need.

SUMMARY OF THE INVENTION

The present invention provides a method and system for storing at least one miniature. Each of the at least one miniature includes a base and a model. The base has a shape. The method and system comprise providing a tray and a tray container. The tray has a slot therein. The slot is configured to hold the base of the at least one miniature. In one aspect, the slot is configured such that a portion of the slot conforms to the shape of the base. In another aspect, the slot has a stationary portion and a movable portion. The stationary and movable portions of the slot are to allow the at least one miniature to be placed within the slot and to allow a portion of the slot to conform to the shape of the base. The tray container is for storing the tray.

According to the system and-method disclosed herein, the present invention provides a storage system for miniatures which can securely hold individual miniatures with little or no damage.

DETAILED DESCRIPTION OF THE INVENTION

The present invention relates to an improvement in the storage if miniatures. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown, but is to be accorded the widest scope consistent with the principles and features described herein.

The present invention provides a method and system for storing at least one miniature. Each of the at least one miniature includes a base and a model. The base has a shape. The method and system comprise providing a tray and a tray container. The tray has a slot therein. The slot is for holding the base of each of the at least one miniature. In one aspect, the slot is configured such that a portion of the slot conforms to the shape of the base. In another aspect, the slot has a stationary portion and a movable portion. The stationary and movable portions of the slot are to allow the at least one miniature to be placed within the slot and to allow a portion of the slot to conform to the shape of the base. The tray container is for storing the tray.

The present invention will be described in terms of certain embodiments used with miniatures having certain base sizes and shapes. However, one of ordinary skill in the art will readily recognize that this method and system will operate effectively for other miniatures having other base sizes and shapes. Furthermore, note that the systems in accordance with the present invention are not drawn to scale.

Figure 1A:
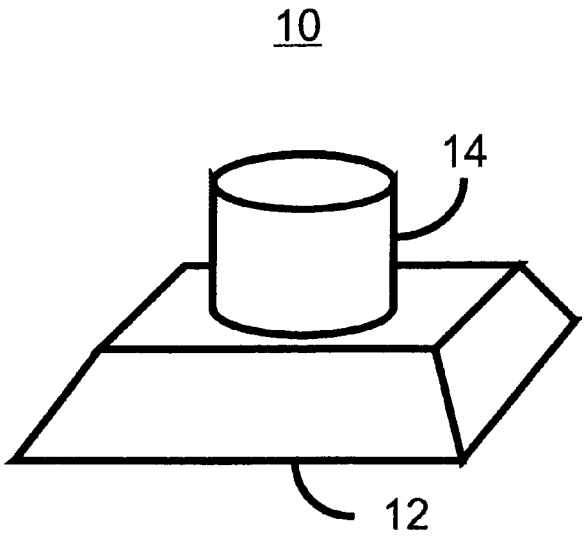
Prior Art Figure 1A
FIG. 1A is a diagram of a miniature having a rectangular base.
Figure 1B:
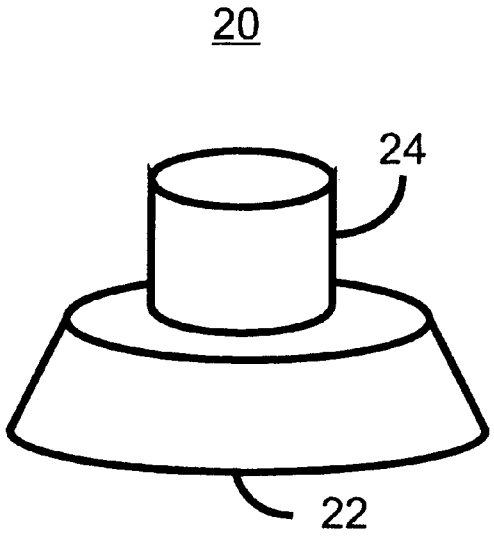
Prior Art Figure 1B
FIG. 1B is a diagram of a miniature having a circular base.
Figure 4A:
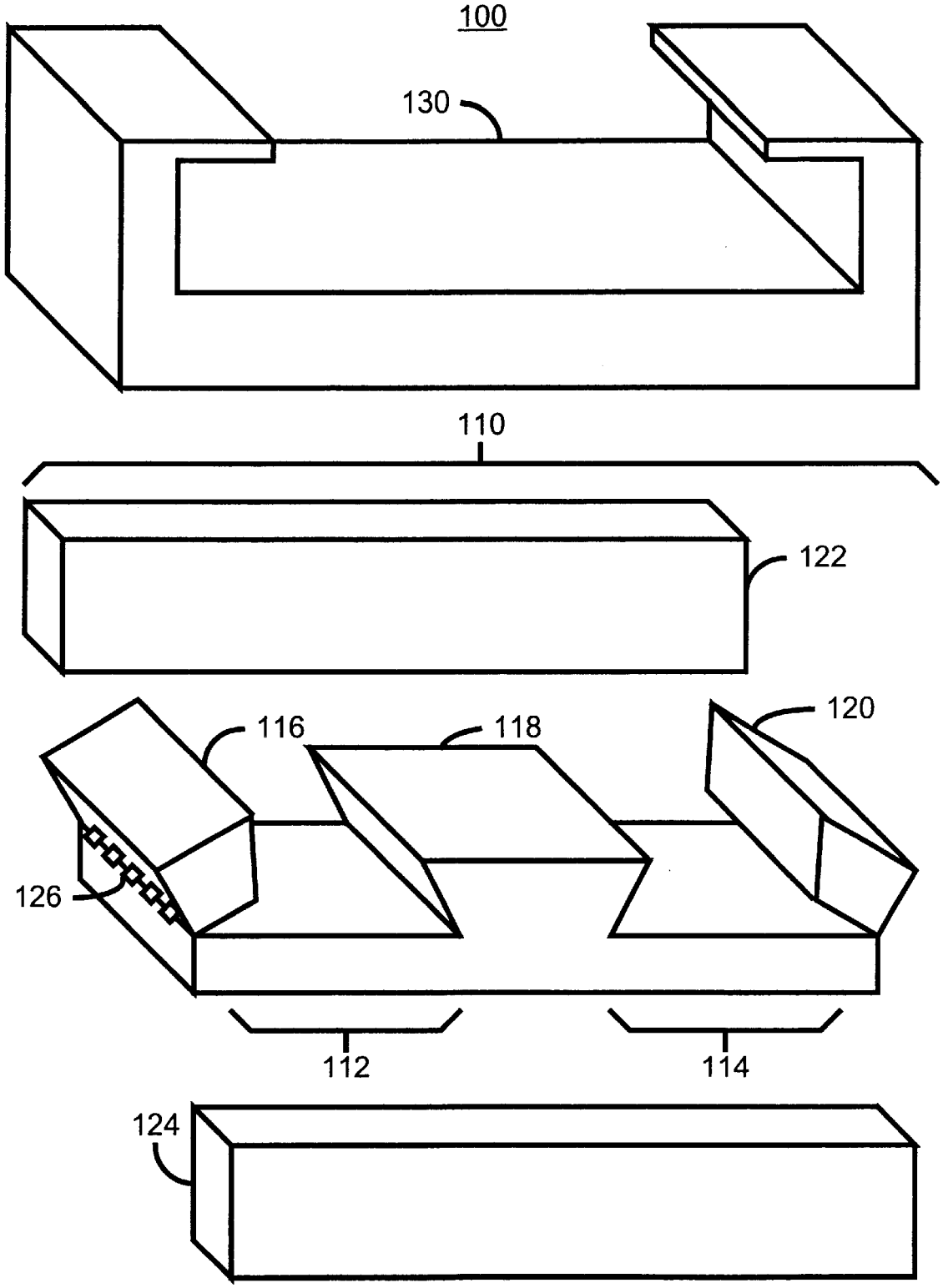
FIG. 4A is a perspective view of one embodiment of a system in accordance with the present invention for storing miniatures with the components of the system separated.
Figure 4B:
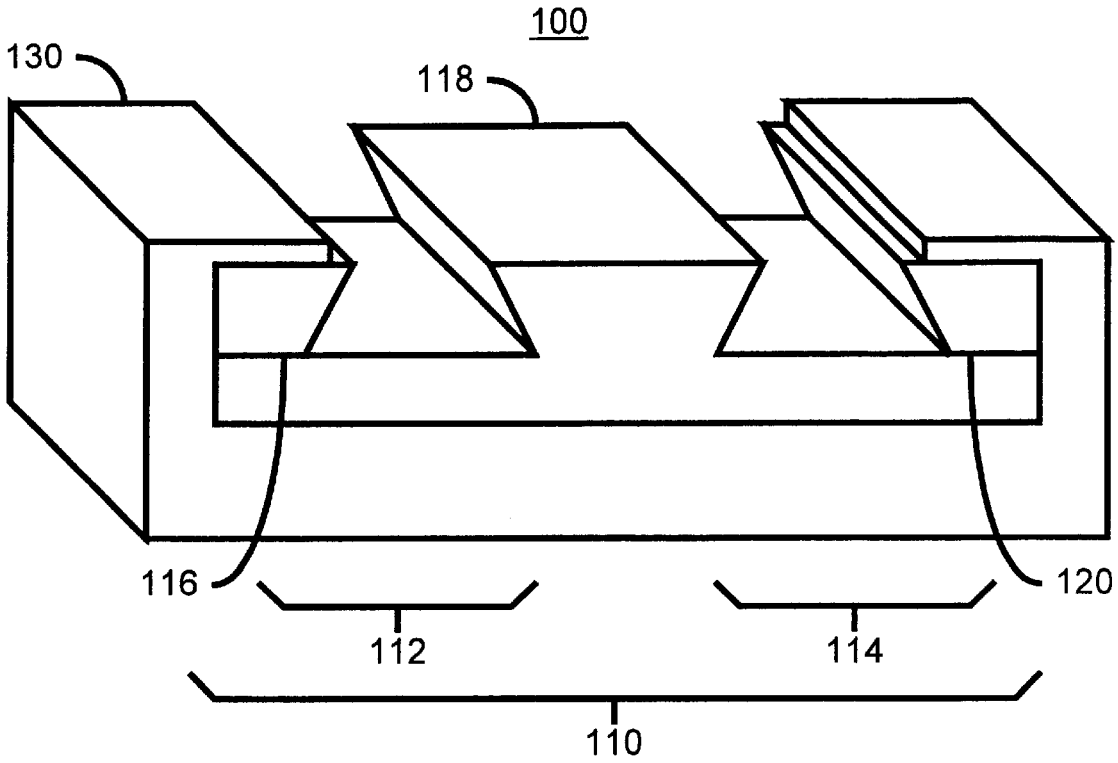
FIG. 4B is a perspective view of one embodiment of a system in accordance with the present invention for storing miniatures.
Figure 4C:
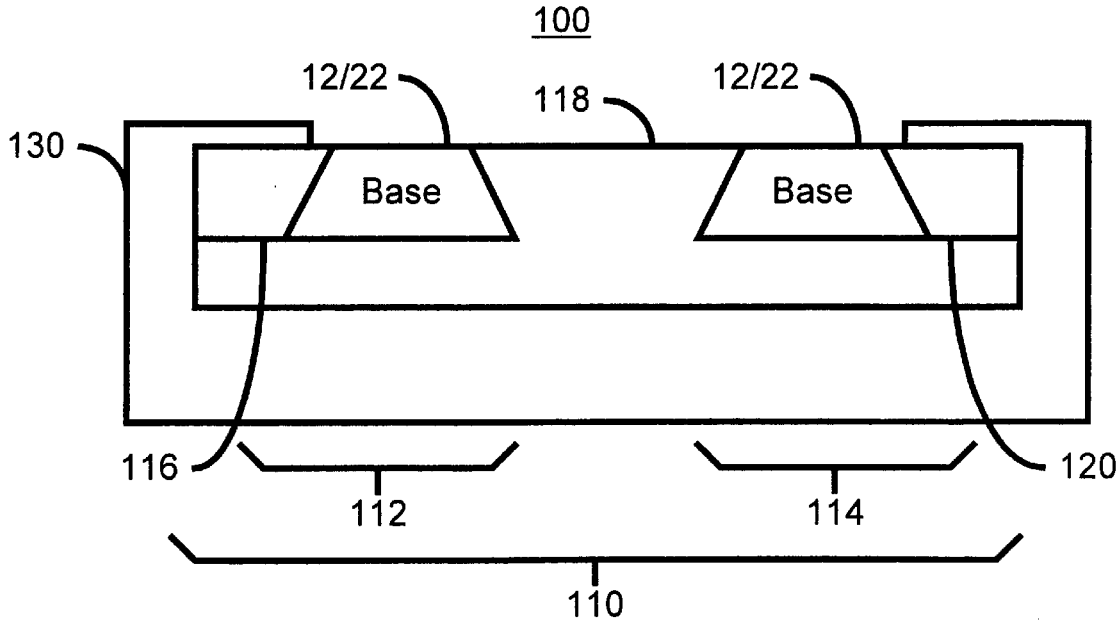
FIG. 4C is a side view of one embodiment of a system in accordance with the present invention for storing miniatures.

To more particularly illustrate the method and system in accordance with the present invention, refer now to FIGS. 4A–4C, depicting one embodiment of a system 100 in accordance with the present invention for storing miniatures. FIG. 4A is a perspective of one embodiment of the system 100 in accordance with present invention with the components of the system 100 separated. FIG. 4B is a perspective view of one embodiment of the system 100 in accordance with present invention. FIG. 4C is a side view of one embodiment of the system 100 in accordance with present invention as shown holding a base 12 or 22. Referring to FIGS. 4A–4C, the system 100 includes a tray 110 and a tray container 130. The tray container 130 depicted in FIGS. 4A–4C is a tray sleeve 130. However, in another embodiment, the container is a box (not shown in FIGS. 4A–4C) capable of holding multiple trays 110. In one embodiment, the tray 110 is injection molded. However, nothing prevents the use of another manufacturing method for providing the tray 110. The tray 110 includes slots 112 and 114 which are separated by a spacer 118. Movable portions 116 and 120 and a stationary portion, the spacer 118, makeup the edges of the slots 112 and 114, respectively. The tray 110 may also optionally include handles 122 and 124 (for clarity shown in FIG. 4A only). The handles 122 and 124 may be made separately from the tray 110 and may have variations in their design. For example, the handles 122 and 124 may have a decorative or informative design on their faces. The handles 122 and 124 may be used for closing the end of the slots 112 and 114. Thus, the handles 122 and 124 might be used to ensure that miniatures, such as a miniatures 110 and 120 depicted in FIGS. 1A and 1B, cannot slide out of the slots 112 and 114. In addition, the handles 122 and 124 may be used for carrying the tray 110.

The slots 112 and 114 are configured to hold the bases 12 and 22 of the miniatures 10 and 20, respectively. Thus, the preferred embodiment, the spacer 118 in the movable portions 116 and 120 are beveled to substantially match the shape of the bases 12 and 22. In other words, the movable portions 116 and 120 and the stationary portion 118 of the slots 112 and 114 are preferably configured to substantially match the slope of the edges of the bases 12 and 22 of the miniatures 10 and 20, respectively, when the movable portions 116 and 120 are closed. When the movable portions 116 and 120 are closed, the bases 12 and 22 preferably fit relatively tightly in the slots 112 and 114. The miniatures 10 and 20 can thus be secured in place. For example, FIG. 4C depicts a side view of the tray 110 and the tray container 130 holding a base 12 or 14. The slots 112 and 114 can, therefore, accommodate the miniature 10 having a square base 12 as well as the miniature 20 having a circular base 22. Also a preferred embodiment the movable portions 116 and 120 can be released to allow the miniatures 10 and 12 to be more easily placed in the slots 112 and 114, respectively. For example, as shown in FIG. 4A, the movable portions 116 and 120 are connected with the hinge 126 and 128, respectively. However, nothing prevents the movable portions 116 and 120 from being moved and different manner to open the slots 112 and 114, respectively. Furthermore, nothing prevents the movable portions 116 and 120 from being replaced with fixed portions (not shown) in the position of the movable portions 116 and 121 closed. In such an embodiment, the slots 112 and 114 themselves are preferably configured to substantially match the slope of the edges of the bases 12 and 22 of the miniatures 10 and 20, respectively. However, for such an embodiment, would be more difficult to access miniatures 10 and 20 stored in the slots 112 and 114.

In a preferred embodiment, a portion of the tray sleeve 130 extends over the movable portions 116 and 120 when the tray 110 is placed within the tray sleeve 130, as shown in FIG. 4B. Therefore, the tray sleeve 130 can be used to clamp the movable portions 116 and 120 closed. When the movable portions 116 and 120 are closed, the bases 12 and 22 fit snugly in the slots 112 and 114, respectively. As a result, the miniatures 10 and 20 storing the slots 112 and 114 will be held securely in place. However, nothing prevents the use of another mechanism for holding the movable portions 116 and 120 open or closed.

The system 100, therefore, secures the miniatures 10 and 20 at the bases 12 and 22, respectively. Neither the tray 110 nor the tray sleeve 130 contacts the models 14 and 24. Consequently, the models 14 and 24 will not be damaged by wear and tear due to contact with any portion of the system 100. This is true even though the models 14 and 24 may vary widely in size. Instead, the miniatures 10 and 20 are secured in place using the portions of the miniatures which are standard sized, in other words, the bases 12 and 22, respectively. In addition, because the bases 12 and 22 are securely held, the miniatures 10 and 20, respectively, will not move when the system 100 is moved. As a result, the miniatures 10 and 20 will not be damaged by movement within the system 100 when the miniatures 10 and 20, respectively, are transported in the system 100. Because the system 100 hold the miniatures 10 and 20 using the bases 12 and 22, respectively, the miniatures 10 and 20 can be stored in close proximity to each other. Thus, a large number of miniatures can be stored safely. In addition, because the movable portions 116 and 120 can be opened, it is easier to access miniatures 10 and 20 stored in the slots 112 and 114. For example, a user-could remove or insert the miniature 10 or 20 stored in the middle of the slots 112 or 114 with other miniatures 10 and 20 surrounding it. The user could remove or insert such a miniature 10 or 20 without requiring the removal of other miniatures closer to the ends of the slots 112 or 114. The system 100, therefore, has the added benefits of allowing the user to easily and rapidly reach the desired miniatures 10 and 20. Note, however, that if movable portions 116 and 120 are replaced by stationary portions (not shown) then miniatures 10 and 20 will be slid in and out of the slots 112. Furthermore, because the system 100 secures the miniatures 10 and 20 via the bases 12 and 14, respectively, the models 14 and 24, respectively, can be seen by a user. Thus, the system 100 can be used to display the miniatures 10 and 20.

Figure 5A:
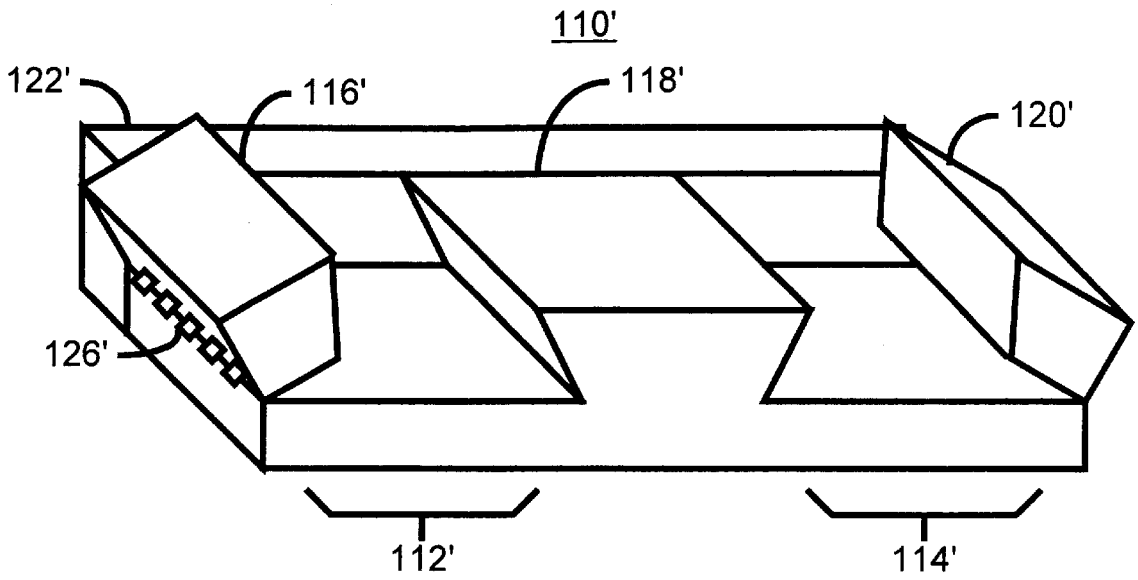
FIG. 5A is a perspective view of a second embodiment of a tray in accordance with the present invention for storing miniatures.
Figure 5B:
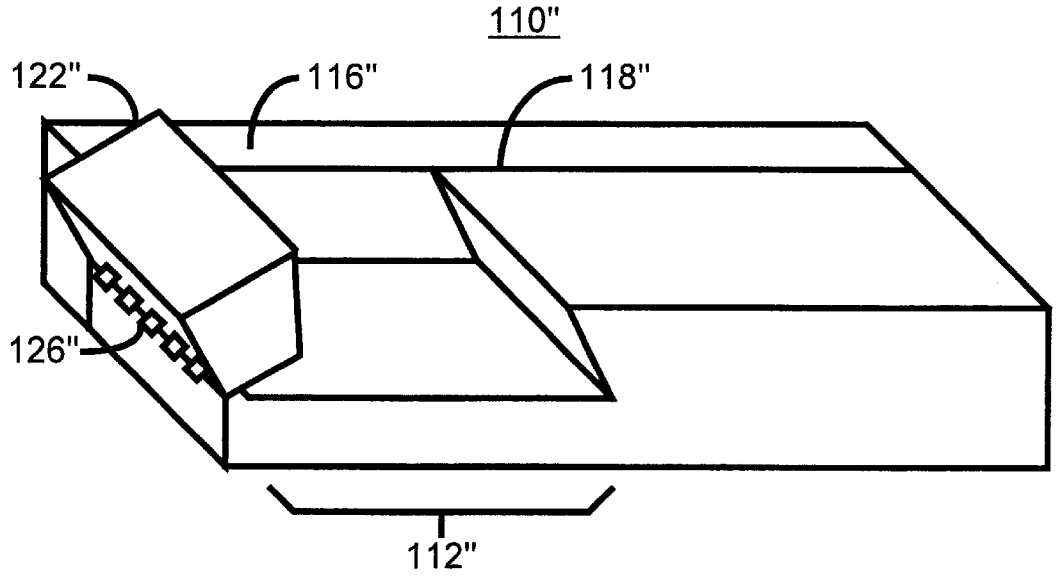
FIG. 5B is a perspective view of a third embodiment of a tray in accordance with the present invention for storing miniatures.

FIGS. 5A–5B depict embodiments of the tray 110 in accordance with the present invention that can be used for miniatures 10 and 20 having bases of different size. FIGS. 4A–4C depict one embodiment a tray 110 preferably for use with miniatures 10 and 20 having a standard sized base 12 of twenty-five millimeters by twenty-five millimeters or a standard sized base 22 twenty-five millimeters in diameter. Thus, the slots 112 and 114 are preferably twenty-five millimeters wide at their bottoms. However, nothing prevents the tray 110 from being configured so that the slots 112 and 114 can fit bases of other sizes. In addition, the slots 112 and 114 are preferably one hundred and twenty-five millimeters long, allowing five miniatures 10 or 20 to be placed in each slot. Thus, in such an embodiment, the tray 110 without the handles 122 and 124 is one hundred and twenty-five millimeters long. However, nothing prevents the slots 112 and 114 and the tray 110 from having a different length.

FIG. 5A is a perspective view of a second embodiment of a tray 110' in accordance with the present invention for storing miniatures having a smaller base 10 or 12, preferably twenty millimeters by twenty millimeters or a diameter of twenty millimeters, respectively. For clarity, the optional front tray handle 124 is not depicted in FIG. 5A. Referring to FIGS. 5A and 4A–4C, many of the components of the tray 110' are similar to the components of the tray 110 and are thus labeled similarly. For example, the slots 112' and 114' of the tray 110' correspond to the slots 112 and 114 of the tray 110. The tray 110' preferably has the same overall dimensions as the tray 110. However, the spacer 118' is different from the spacer 118. In particular, the spacer 118' is preferably ten millimeters wider than the spacer 118. The spacer 118' is preferably still placed near the center of the tray 110'. Consequently, the slots 112' and 114' are each five millimeters thinner than the slots 112 and 114. The slots 112' and 114 are, therefore, twenty millimeters in diameter at the bottom and capable of securing miniatures 10 and 20 having smaller bases while having the same overall dimensions as the tray 110. Thus, the tray sleeve 130 could still be used with the tray 110'.

FIG. 5B is a perspective view of a third embodiment of a tray 110' in accordance with the present invention for storing miniatures having a larger base 10 or 12, preferably forty millimeters by forty millimeters or a diameter of forty millimeters, respectively. Note, however, that currently, only the rectangular base 12 comes in multiple sizes. For clarity, the optional front tray handle 124 is not depicted in FIG. 5B. Referring to FIGS. 5B and 4A–4C, many of the components of the tray 110" are similar to the components of the tray 110 and are thus labeled similarly. For example, the slot 112" of the tray 110" correspond to the slot 112 of the tray 110. The tray 110" preferably has the same overall dimensions as the tray 110. However, the spacer 118" is different from the spacer 118. In particular, the spacer 118" is preferably wide enough to occupy enough of the tray 110' that the slot 112" is forty millimeters in diameter at the bottom and capable of securing miniatures 10 and 20 having larger bases while having the same overall dimensions as the tray 110. Thus, the tray sleeve 130 could still be used with the tray 110".

Figure 6:
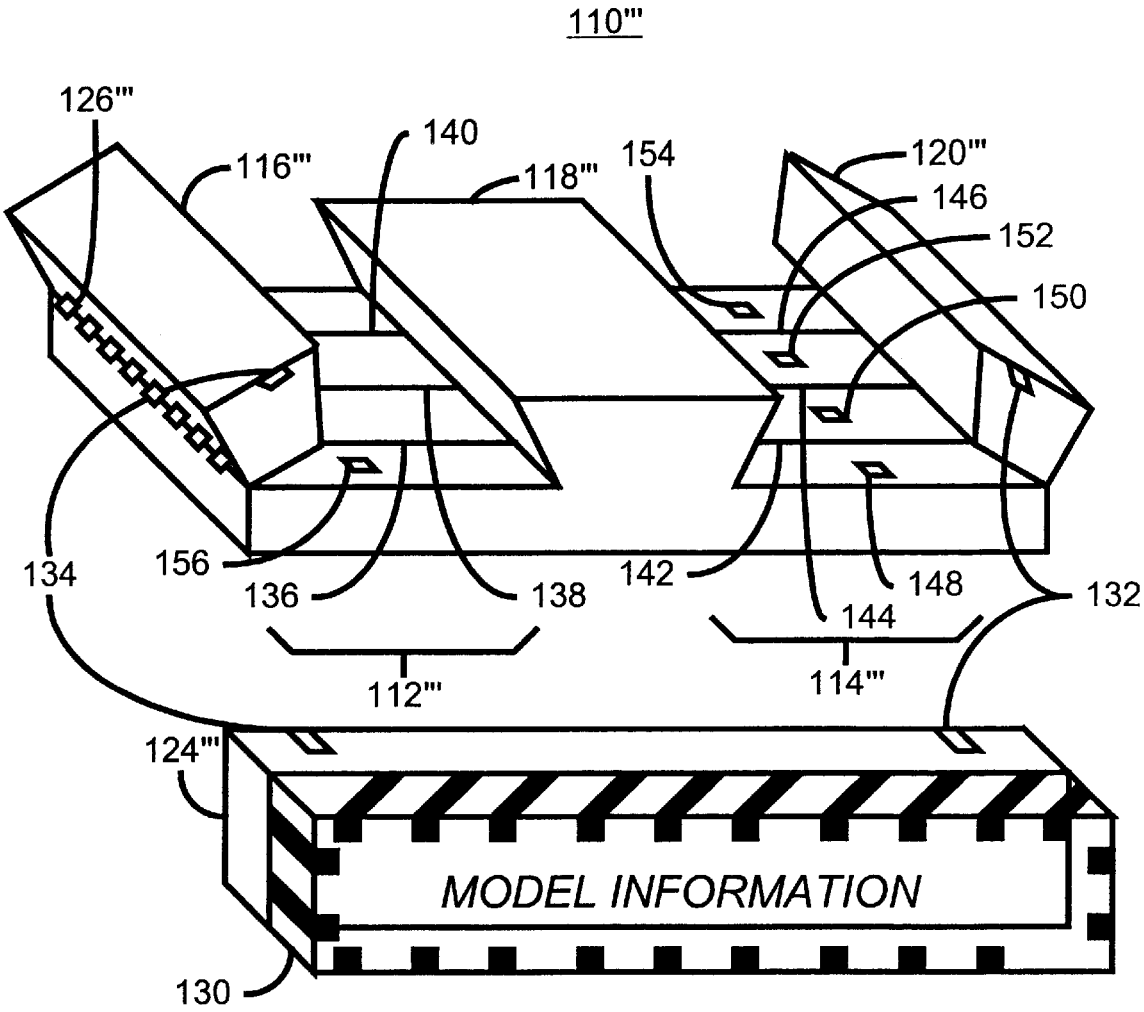
FIG. 6 is a perspective view of a fourth embodiment of a tray in accordance with the present invention for storing miniatures.

FIG. 6 is an exploded perspective view of a fourth embodiment of a tray 110''' in accordance with the present invention for storing miniatures. Many of the components of the tray 110''' are similar to the tray 110. Consequently, these are labeled similarly. For example, the slots 112''' and 114''' correspond to the slots 112 and 114 depicted in FIGS. 4A–4C. Referring back to FIG. 6, for clarity, however, the optional back tray handle 122 is not shown. The slot 112''' includes partitions 136, 138 and 140. Similarly, the slot 114" includes partitions 142, 144, 146 and 148. The partitions 136, 138, 140, 142, 144 and 146 ensure that the bases 12 and 14 of the miniatures 10 and 20, respectively, do not contact the bases 12 and 14 of other miniatures 10 and 20, respectively. In a preferred embodiment, the partitions 136, 138, 140, 142, 144 and 146 are approximately 0.5 millimeters wide and approximately 0.5 millimeters high. In such an embodiment, the overall dimensions of the tray 110''' may be made longer. For example, if the tray 110 is one hundred and twenty-five millimeters long, the tray 110''' may be made two millimeters longer. The two millimeters would accommodate four partitions, such as the partitions 136, 138, 140, 142, 144 and 146 to separate five miniatures 10 and 20. However, nothing prevents the partitions 136, 138, 140, 142, 144 and 146 and tray 110''' from having different dimensions. In addition, nothing prevents the tray 110''' from having another number of partitions 136, 138, 140, 142, 144 and 146.

The tray 110''' is also depicted as having locks 132 and 134. The locks 132 and 134 can be used to lock the movable portions 116''' and 120''' in place. The locks 132 and 134 may be used in lieu of the tray sleeve 130 for holding the movable portions 116''' and 120''' in place, thereby securing the miniatures 10 and 20 stored in the tray 110'''. The locks 132 and 134 are preferably snap type locks that could be easily opened by a user without damaging any miniatures 10 and 20 stored in the tray 110'''.

The tray 110''' also includes recesses 148, 150, 152, 154 and 156. The recesses 148, 150, 152, 154 and 156 are used to align certain miniatures 10 and 20. Some miniatures 10 and 20 include an alignment key (not shown). The alignment key for the miniature 10 or 20 can be inserted into the appropriate one of the recesses 148, 150, 152, 154 and 156. Thus, the miniature 10 or 20 can be kept from rotating in the slot 112''' or 114'''.

On the handle 124''' at one end of the tray 110''' is a faceplate 130. The faceplate 130 can be placed on the tray handle 124''' or the tray 110''' itself. The faceplate 130 is preferably decorative in nature. The face plate 130 could also be informative, for example indicating the models 10 and 20 stored in the system 100.

Figure 2:
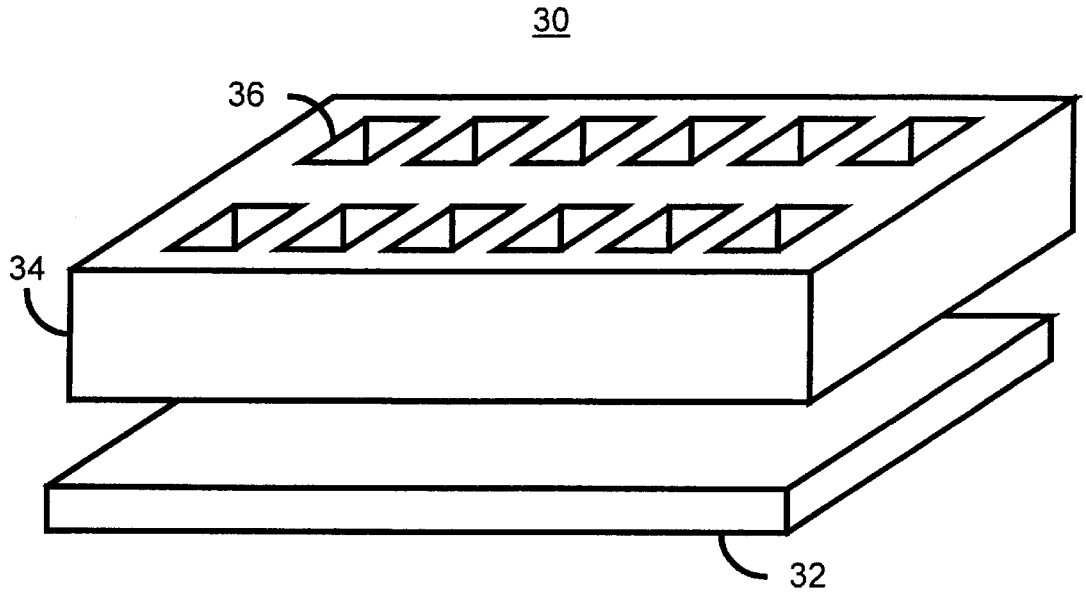
Prior Art Figure 2
FIG. 2 is a diagram of a conventional case for storing miniatures.
Figure 3:
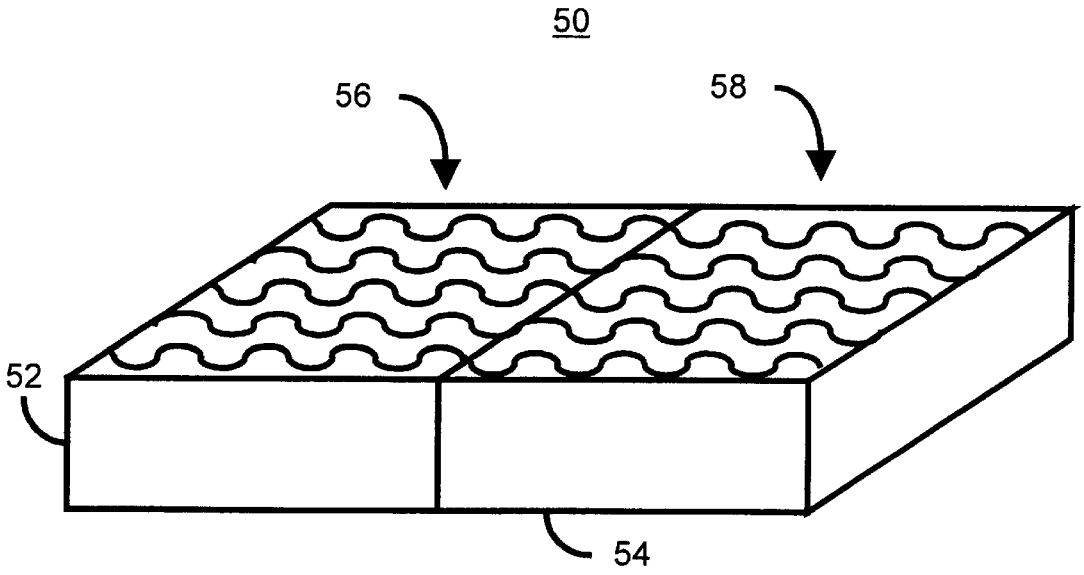
Prior Art Figure 3
FIG. 3 is a diagram of another conventional case for storing miniatures.
Figure 7:
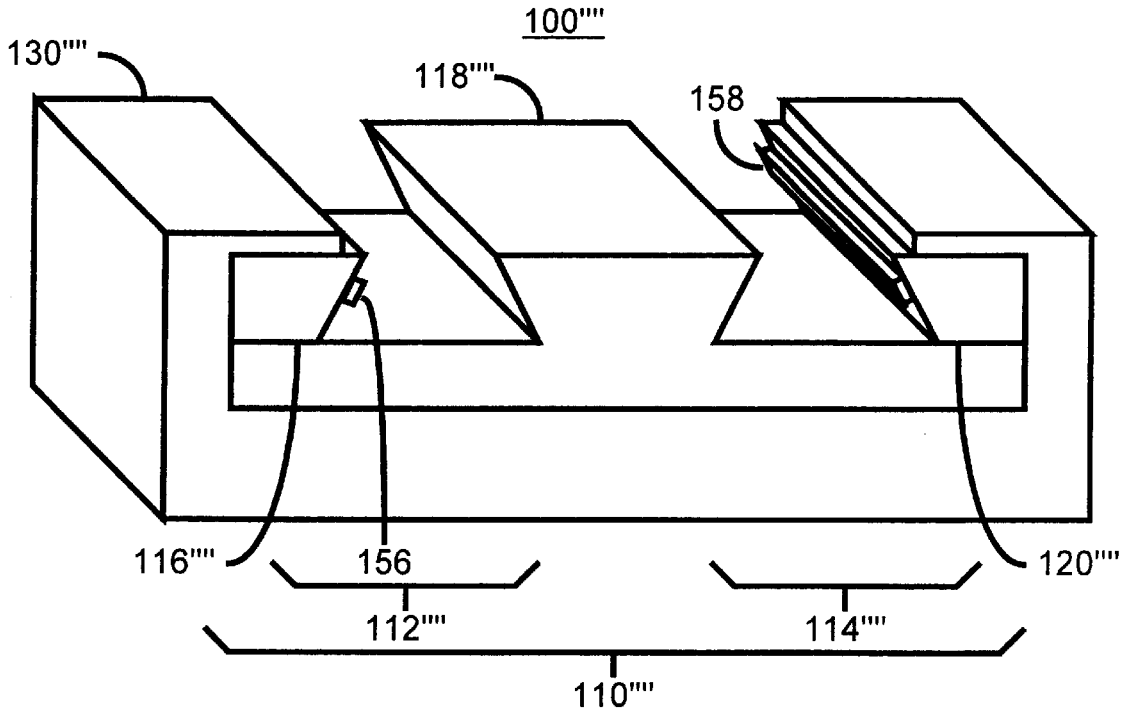
FIG. 7 is a perspective view of another embodiment of a system in accordance with the present invention for storing miniatures.

FIG. 7 is a perspective view of another embodiment of a system in 100'''' in accordance with the present invention for storing miniatures. The system 100'''' is substantially the same as the system 100 depicted in FIG. 2. Consequently, these components are labeled similarly. However, the system 100'''' includes spacers 156 and 158. The spacers 156 and 158 are preferably made of single-sided foam tape. Thus, the spacers 156 and 158 can be affixed to the sides of the slots 112'''' and 114'''', respectively, without sticking to miniatures 10 and 20 held by the system 100''''. Although the spacers 156 and 158 are shown as being coupled to the movable portions 116'''' and 120'''', respectively, spacers (not shown) could be coupled to the beveled edges of the stationary portion 118'''' within the slots 112'''' and 114''''. Furthermore, although two spacers 156 and 158 are shown, nothing prevents the use of another number of spacers. Although the spacers 156 and 158 are depicted as extending along the entire length of the slots 112'''' and 114'''', nothing prevents the spacers 156 and 158 from having a different length.

The spacers 156 and 158 may account for slight irregularities in the bases 12 and 22. The spacers 156 and 158 allow the movable portions 116'''' and 120'''' to exert pressure on the bases 12 and 22 even when the portion of the bases 12 and 22 in proximity to the movable portions 116'''' and 120'''' has parts that are smaller than the widths of the slots 112'''' and 114'''', respectively. Thus, despite irregularities in the bases 12 and 22, the system 100'''' can securely hold the miniatures 10 and 20 through the use of the spacers 156 and 158.

Figure 8:
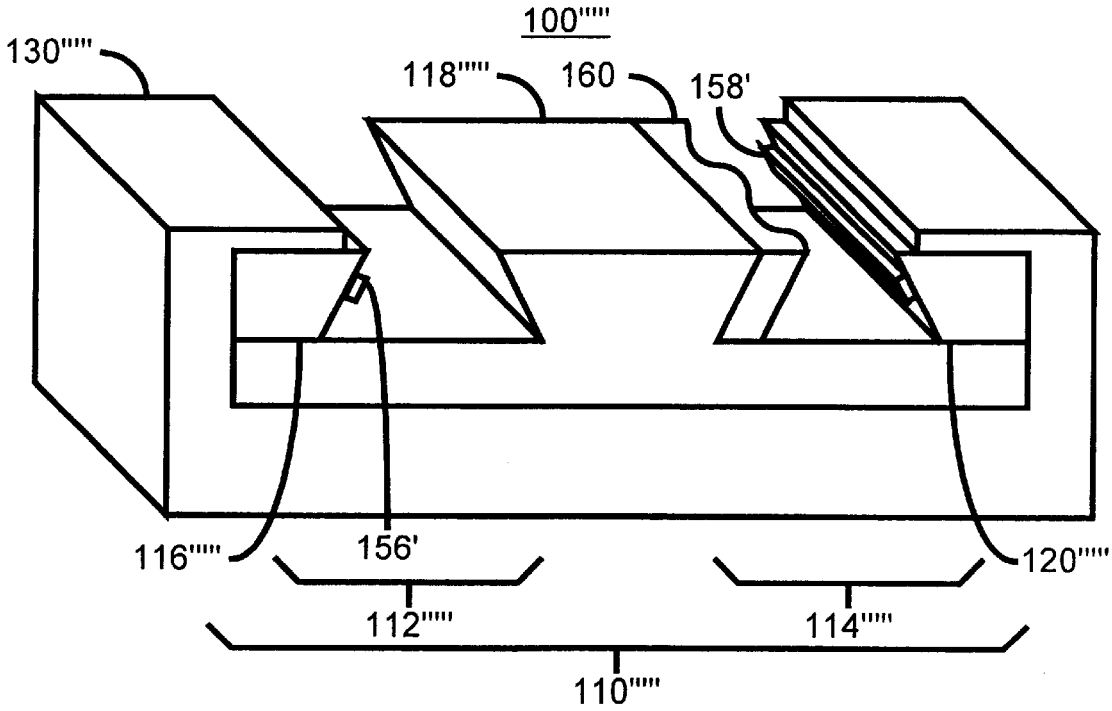
FIG. 8 is a perspective view of a third embodiment of a system in accordance with the present invention for storing miniatures.

FIG. 8 is a perspective view of a third embodiment of a system 100''''' in accordance with the present invention for storing miniatures. The system 100''''' has many components that are similar to the components of the system 100''''. Consequently, these components are labeled similarly. The system 100''''' also includes an additional spacer 160 having round cut-outs. The cut-outs are preferably arcs of a circle, such as a semicircle. The spacer 160 aids in ensuring that circular bases 22 can be securely held by the system 100'''''. Without the spacers 160, 156 and 158, a circular base 22 would contact the sides of the slots 112''''' and 114''''' tangentially at approximately two points. Thus, it might be difficult to ensure that the miniature 20 is securely held. The spacer 160 is specially made to contact more portions of the edge of the circular base 22. Thus, the model 20 may be more securely held. Note that although the spacer 160 is shown as used in conjunction with the spacers 156' and 158', nothing requires the use of the spacers 156' and 158'. Furthermore, the spacer 160 could also be used in place of the spacer 156 or 158. Although only one spacer 160 is depicted, the spacer could also be used in the slot 112'. Although the spacer 160 is shown as being coupled to the stationary portion 118'''', spacers (not shown) could be coupled to the beveled edges of the movable portions 116''''' and 120''''' within the slots 112''''' and 114'''''. Although the spacer 160 is depicted as extending along the entire length of the slots 112 and 114, nothing prevents the spacers 156 and 158 from having a different length.

Figure 9:
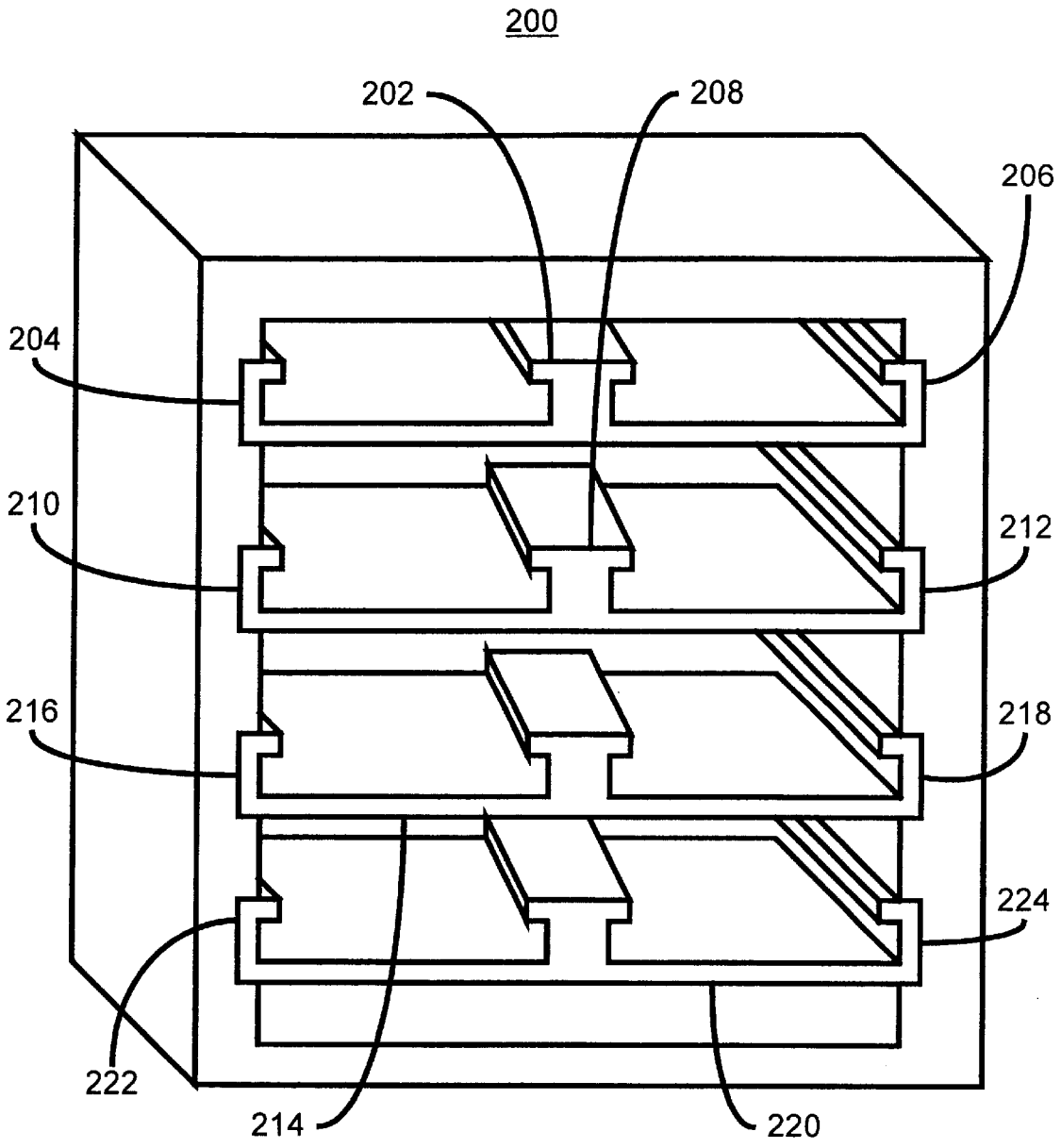
FIG. 9 is a perspective view of one embodiment of a tray box in accordance with the present invention.

FIG. 9 is a perspective view of one embodiment of a tray box 200 in accordance with the present invention. The tray box 200 is a type of tray container 130. The tray box 200 can be used as a case for transporting the miniatures. The box 200 has shelves 202, 208, 214 and 220. Although four shelves are depicted, nothing prevents another number from being used. Each shelf 202, 208, 214 and 220 is preferably made up of four trays 110, 110', 110", 110''', 110'''' and 110'''''. The four trays 110. 110', 110"110''', 110'''', or 110''''' preferably join at the edges. Thus, in a preferred embodiment, the tray box 200 has dimensions of twelve inches by twelve inches by six inches for width by height by depth. Thus, the tray box 200 can accommodate up to one hundred and sixty miniatures 10 and 20. The shelves 202, 208, 214 and 220 can preferably be varied in height to accommodate miniatures 10 and 20 having different heights. The box 200 includes grooves 204, 206, 210, 212, 216, 218, 222 and 224. Note that the grooves 204 and 206, the grooves 210 and 212, the grooves 216 and 218, and the grooves 222 and 224 may be continuous. The grooves 204, 206, 210, 212, 216, 218, 222 and 224 help keep trays 110, 110', 110" and 110" stored in the box 200 from moving. Although only the grooves 204, 206, 210, 212, 216, 218, 222 and 224 are shown, more grooves are preferably provided to accommodate the trays 202, 208, 214 and 220 of varying heights, trays at different heights or a different number of trays. Preferably, the grooves spaced are ¾ inches apart. In one embodiment, the tray box 200 is vacuum formed.

Thus, the systems 100, 100', 100", 100''', 100'''' and 100''''' can securely store miniatures 10 and 20 with decreased danger of damage to the models 114 and 124. The systems 100, 100', 100", 100''', 100'''' and 100''''' can be used to display and transport miniatures 10 and 20. The systems 100, 100', 100", 100''', 100'''' and 100''''' can also provide easy access to the miniatures 10 and 20 stored therein. Thus, the systems 100, 100', 100", 100''', 100'''' and 100''''' provide many advantages over conventional systems.

A method and system has been disclosed for storing miniatures in a manner that is simple, efficient and relatively secure. Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A system for storing at least one miniature, the at least one miniature including a base and a model, the base having a shape, the system comprising:

a tray having a slot therein, the slot being configured to hold the base of the at least one miniature, the slot having a stationary portion and a movable portion for allowing the at least one miniature to be placed within the slot and for allowing a portion of the slot to conform to the shape of the base; and a tray container for storing the tray.

2. The system of claim 1 wherein the stationary portion and the movable portion of the slot are beveled to conform to the shape of the base.

3. The system of claim 1 wherein the movable portion of the slot further includes a hinge and an edge coupled with the hinge, the edge rotating around the hinge to widen the slot to allow the at least one miniature to be placed in the slot.

4. The system of claim 3 wherein the tray container further includes a tray sleeve, a portion of the tray sleeve overlapping the hinge and the edge to clamp the edge in place.

5. The system of claim 3 wherein the movable portion of the slot further includes a lock coupled to the hinge for clamping the edge in place.

6. The system of claim 1 wherein the slot includes an end and wherein the tray sleeve further includes a tray handle, the tray handle for providing a barrier at the end of the slot.

7. The system of claim 1 wherein the slot further includes at least one partition for separating the at least one miniatures capable of being held in the slot.

8. The system of claim 1 wherein the at least one miniature is capable of including an alignment key and wherein the slot further includes at least one recess, the at least one recess for receiving the alignment key and aligning the at least one miniature in the slot.

9. The system of claim 1 further comprising:

a faceplate coupled to the tray.

10. The system of claim 1 further comprising:

a spacer coupled with the movable portion of the slot, the spacer for ensuring that stationary portion and the movable portion of the slot can hold the at least one miniature in a desired location.

11. The system of claim 10 wherein the spacer further. has at least one semicircular depression therein, the semicircular depression for holding a base having a circular shape.

12. The system of claim 1 further comprising:

a spacer coupled with the stationary portion of the slot, the spacer for ensuring that stationary portion and the movable portion of the slot can hold the at least one miniature in a desired location.

13. The system of claim 12 wherein the spacer further has at least one semicircular depression therein, the semicircular depression for holding a base having a circular shape.

14. The system of claim 1 wherein the tray container further includes a tray box capable of holding a plurality of trays, each of the plurality of trays being held in a desired location in the tray box.

15. A system for storing at least one miniature, the at least one miniature including a base and a model, the base having a shape, the system comprising:

a tray having a slot therein, the slot being configured to hold the base of the at least one miniature, a portion of the slot conforming to the shape of the base, the slot being configured to hold the base of the at least one miniature, the slot having a stationary portion and a movable portion for allowing the at least one miniature to be placed within the slot and for allowing a portion of the slot to conform to the shape of the base; and a tray container for storing the tray.

16. A method for storing at least one miniature, the at least one miniature including a base and a model, the base having a shape, the method comprising the steps of:

(a) placing the at least one miniature in a tray, the tray having a slot therein, the slot being configured to hold the base of the at least one miniature, the slot having a stationary portion and a movable portion for allowing the at least one miniature to be placed within the slot and for allowing a portion of the slot to conform to the shape of the base, the at least one miniature being placed in the slot of the tray;

(b) moving the movable portion of the slot to retain the at least one miniature; and (c) placing the tray in a tray container for storing the tray.

* * * * *